US006948262B2

(12) United States Patent
Kerrigan

(10) Patent No.: US 6,948,262 B2
(45) Date of Patent: Sep. 27, 2005

(54) CANTILEVERED SHOE CONSTRUCTION

(76) Inventor: D. Casey Kerrigan, 525 Rookwood Pl., Charlottesville, VA (US) 22903

( * ) Notice: Subject to any disclaimer, the term of this patent is extended or adjusted under 35 U.S.C. 154(b) by 85 days.

(21) Appl. No.: 10/429,936

(22) Filed: May 5, 2003

(65) Prior Publication Data

US 2004/0040183 A1 Mar. 4, 2004

Related U.S. Application Data

(63) Continuation-in-part of application No. 09/825,260, filed on Apr. 3, 2001, now Pat. No. 6,725,578.

(60) Provisional application No. 60/427,663, filed on Nov. 19, 2002, and provisional application No. 60/415,925, filed on Oct. 3, 2002.

(51) Int. Cl.[7] ..... A43B 13/28

(52) U.S. Cl. ..... 36/27; 36/28

(58) Field of Search ..... 36/27, 7.8, 28, 36/143, 144, 151, 152, 157, 158, 168, 171, 179, 91

(56) References Cited

U.S. PATENT DOCUMENTS

| | | | | |
|---|---|---|---|---|
| 931,353 A | | 8/1909 | Riley | |
| 957,718 A | | 5/1910 | Schumacher | |
| 1,039,396 A | | 9/1912 | Hilgert | |
| 1,103,914 A | | 7/1914 | Eaton | |
| 1,199,911 A | * | 10/1916 | MacFarland | 36/157 |
| 1,287,810 A | | 12/1918 | Wojteck | |
| 1,418,048 A | * | 5/1922 | Abramowitz | 36/179 |
| 1,477,825 A | | 12/1923 | Heitler | |
| 1,690,837 A | * | 11/1928 | Rehle | 36/168 |
| 1,696,786 A | * | 12/1928 | Wood | 36/168 |
| 1,698,003 A | * | 1/1929 | Rieke | 36/179 |
| 1,806,409 A | | 5/1931 | Nickerson | |
| 1,928,634 A | * | 10/1933 | Spicer et al. | 36/179 |
| 1,996,215 A | | 4/1935 | Sabiston et al. | 37/71 |
| 2,022,247 A | * | 11/1935 | Lobel | 36/168 |
| 2,043,396 A | * | 6/1936 | Schnellbacher | 36/158 |
| 2,135,504 A | | 11/1938 | Hack | 36/8.5 |

(Continued)

FOREIGN PATENT DOCUMENTS

| | | |
|---|---|---|
| DE | 10 55 400 B | 4/1959 |
| DE | 3735496 A1 | 5/1989 |
| DE | 203 05 000 U | 7/2003 |
| DE | 102 12 862 C1 | 10/2003 |

(Continued)

OTHER PUBLICATIONS

D. Casey Kerrigan, et al., Effectiveness of a Lateral–Wedge Insole on Knee Varus Torque in Patients with Knee Osteoarthritis, Arch Phys Med Rehabil vol. 83, pp. 889–893, Jul. 2002.

Kiepe, C., Int'l Search Report, PCT/US2004/013959, May 5, 2004.

*Primary Examiner*—Ted Kavanaugh
(74) *Attorney, Agent, or Firm*—Bromberg & Sunstein LLP

(57) ABSTRACT

A cantilevered shoe construction for preventing knee and hip osteoarthritis. The shoe construction includes a cantilevered foot support with an anchored lateral side and a fully or partially cantilevered medial side. The cantilevered foot support transfers forces, otherwise transmitted through the medial aspect of the shoe and foot, to the lateral side of the shoe and foot, thereby reducing the knee varus and hip adductor torques to prevent or delay onset of knee and hip osteoarthritis and reducing the ankle joint adductor torque to reduce the risk for ankle sprain injury. The reduction of these joint torques also maintains posture without counterbalancing muscle activity, thereby improving muscle efficiency and performance during weight bearing activities and reducing the tendency for musculoskeletal injury. A spring loading effect of other embodiments enhances the natural coronal foot progression during gait so as to enhance the push off phase of gait.

34 Claims, 11 Drawing Sheets

U.S. PATENT DOCUMENTS

| | | | | | |
|---|---|---|---|---|---|
| 2,188,182 | A | | 1/1940 | Gould | 36/71 |
| 2,266,369 | A | | 12/1941 | Kohn | 12/133 |
| 2,369,226 | A | | 2/1945 | Gordon | 36/8.5 |
| 2,512,350 | A | * | 6/1950 | Ludlam | 36/179 |
| 2,576,247 | A | | 11/1951 | Woodthrope | 36/71 |
| 2,698,490 | A | | 1/1955 | Goldman | 36/8.5 |
| 2,769,251 | A | | 11/1956 | Elsey | 36/8.5 |
| 2,862,313 | A | | 12/1958 | Jones | 36/71 |
| 3,086,532 | A | | 4/1963 | Mistarz | 128/586 |
| 3,586,003 | A | | 6/1971 | Baker | 128/586 |
| 3,951,407 | A | | 4/1976 | Calacurcio | 273/32 C |
| 4,166,329 | A | | 9/1979 | Herbig | 36/97 |
| 4,170,233 | A | | 10/1979 | Bunsick | 128/586 |
| 4,258,480 | A | | 3/1981 | Famolare, Jr. | 36/91 |
| 4,342,158 | A | | 8/1982 | McMahon et al. | 36/35 R |
| 4,372,058 | A | | 2/1983 | Stubblefield | 36/32 R |
| 4,398,357 | A | | 8/1983 | Batra | 36/30 A |
| 4,527,345 | A | | 7/1985 | Lopez | 36/127 |
| 4,619,056 | A | | 10/1986 | Lin et al. | 36/43 |
| 4,674,206 | A | | 6/1987 | Lyden | 36/88 |
| 4,689,898 | A | | 9/1987 | Fahey | 36/43 |
| 4,785,557 | A | | 11/1988 | Kelley et al. | 36/32 R |
| 4,798,010 | A | | 1/1989 | Sugiyama | 36/30 R |
| 4,910,884 | A | | 3/1990 | Lindh et al. | 36/28 |
| 5,282,326 | A | | 2/1994 | Schroer, Jr. et al. | 36/44 |
| 5,319,866 | A | | 6/1994 | Foley et al. | 36/91 |
| 5,337,492 | A | | 8/1994 | Anderie et al. | 36/28 |
| 5,400,528 | A | | 3/1995 | Skinner et al. | 36/161 |
| 5,463,824 | A | | 11/1995 | Barna | 36/44 |
| 5,560,126 | A | | 10/1996 | Meschan et al. | 36/42 |
| 5,678,327 | A | | 10/1997 | Halberstadt | 36/27 |
| 5,727,335 | A | | 3/1998 | Kousaka et al. | 36/31 |
| 5,729,912 | A | | 3/1998 | Gutkowski et al. | 36/97 |
| 5,940,994 | A | * | 8/1999 | Allen | 36/168 |
| 6,598,320 | B2 | | 7/2003 | Turner et al. | 36/28 |
| 6,694,642 | B2 | | 2/2004 | Turner | 36/28 |
| 6,722,058 | B2 | | 4/2004 | Lucas et al. | 36/28 |
| 2002/0139011 | A1 | | 10/2002 | Kerrigan | 36/144 |
| 2003/0208929 | A1 | | 11/2003 | Lucas et al. | 36/28 |
| 2004/0040183 | A1 | | 3/2004 | Kerrigan | 36/144 |

FOREIGN PATENT DOCUMENTS

| | | |
|---|---|---|
| DE | 102 34 913 A1 | 2/2004 |
| DE | 102 44 433 A1 | 4/2004 |
| DE | 101 12 821 B9 | 10/2004 |
| EP | 0 394 119 | 10/1990 |
| GB | 438481 | 11/1935 |

* cited by examiner

CANTILEVERED SHOE CONSTRUCTION

The present application is a continuation-in-part of U.S. application Ser. No. 09/825,260, filed Apr. 3, 2001 now U.S. Pat. No. 6,725,578, and also claims priority from U.S. provisional application No. 60/415,925, filed Oct. 3, 2002, and from U.S. provisional application No. 60/427,663, filed Nov. 19, 2002. All of these applications are hereby incorporated by reference.

FIELD OF THE INVENTION

Embodiments of the present invention relate to footwear construction that simultaneously prevents knee and hip osteoarthritis, reduces the risk for musculoskeletal injury, and improves efficiency and athletic performance. More particularly, embodiments relate to footwear construction that is comfortable and adequately supports the foot yet transfers forces from the medial to the lateral side of the foot thereby reducing specific lower extremity joint torques. The reduction in these lower extremity torques reduces the forces and wear and tear through the knee and hip joints, reduces the risk for a number of common musculoskeletal injuries, and reduces the need for counterbalancing muscle activity to maintain posture, thereby improving muscle efficiency and performance of walking, running, jumping, and other weight bearing activities. Certain embodiments of the present invention additionally provide a spring loading effect that enhances the natural coronal foot progression during gait thereby enhancing the push off phase of gait.

BACKGROUND OF THE INVENTION

Nearly every person living long enough develops some degree of osteoarthritis, sometimes referred to as degenerative or wear-and-tear arthritis in both the knees and hips. Osteoarthritis becomes disabling when the articular cartilage covering the joint degenerates, resulting in areas of the joint where bone rubs against bone. Knee osteoarthritis in particular, which most typically occurs on the medial aspect of the knee, accounts for more disability with respect to mobility than any other disease in the elderly. That the medial aspect of the knee is particularly susceptible is due to the fact that during walking (and other weight bearing activities), an external varus knee torque throughout the stance period imparts a continuous compressive force across the medial aspect of the knee. While the medial aspect of the knee is most susceptible to arthritis, the varus torque makes the entire knee susceptible by necessitating counterbalancing muscle activity that imparts substantial muscle compressive forces throughout the knee.

Other than avoiding acute joint trauma and maintaining normal body weight, there are no proven measures to reduce the inevitable wear and tear during weight bearing activities of the knee such that the gradual development of knee osteoarthritis can be prevented or mitigated. Footwear or shoes often include material in the soles that absorb shock. However, because shock absorbing material does not actually reduce joint torques or forces during walking or other weight bearing activities, the propensity to knee and hip osteoarthritis is unchanged. Although shoe designs and arch supports often support the medial side of the foot, including the natural arch of the foot, they affect only the anatomy of the foot and do not reduce (and in fact can increase) the knee varus and hip adductor torques.

A laterally wedged heel or sole can reduce knee varus torque. While a wedge-like sole could be acceptable as a treatment modality for a person who already has knee osteoarthritis, the shoe insert alone is unlikely to be an acceptable preventative device that could be useful to a healthy person in preventing knee osteoarthritis. In use, such a shoe insert or design will tend to pronate the foot and collapse the natural arch. Such a tendency toward collapse of the foot arch with repetitive steps is likely to be uncomfortable for healthy people and athletes, and probably does not warrant the risk of foot injuries and deformities. Moreover, the end result of a collapsed foot arch would be an increase rather than a decrease in the knee varus and also hip adductor torques.

Thus, there is a need for a footwear design that both comfortably and adequately supports the foot and prevents pronation, yet also reduces the external knee varus torque and potentially also reduces the hip adductor torque and ankle inversion torque. By reducing the knee varus and hip adductor torque, less counterbalancing muscle activity would be required, resulting in reduction of the forces throughout the knee (not just the medial side) and hip. Such a design would be particularly useful for prevention of both knee and hip osteoarthritis and could help prevent common musculoskeletal injuries including hip pointers and ankle sprain injury. By reducing the joint torques in the coronal plane (knee varus, hip adductor and ankle inversion), the design would simultaneously reduce the need for counterbalancing muscle activity (and strain) in the coronal plane to maintain posture, thus improving muscle efficiency and athletic performance during weight bearing activities. There is currently no effective shoe design that reduces the need for muscle activity related to the coronal plane.

SUMMARY OF THE INVENTION

Embodiments of the present invention relate to a shoe construction for both improving athletic performance and preventing knee and hip osteoarthritis. By virtue of the biomechanical design in relation to the foot and lower extremity, the shoe and/or shoe components of the embodiments reduce the forces through the knee and hip joints during ground contact with the foot. Thus, the shoe does not merely support the foot or reduce shock through the body, but beneficially alters the torques and forces proximal to the foot at the ankle, knee and hip. This shoe construction is appropriate for all types of footwear, as it protects against the development of lower extremity osteoarthritis over a lifetime. In addition, the embodiments, by virtue of the biomechanical design, are comfortable, improve ankle stability, and improve biomechanical efficiency and performance during weight bearing activities.

More particularly, embodiments of the invention provide a footwear construction that reduces lower extremity joint torques. The footwear construction reduces the knee joint varus torque and hip adductor torque during weight bearing activities and athletic endeavors such as walking, standing, running, and jumping. Reducing the knee varus torque reduces the compressive force through the medial aspect of the knee where arthritis is most common and, in addition, indirectly, through reduced counterbalancing muscle requirements, reduces the overall force through the rest of the knee, including the lateral aspect of the knee.

Reducing the hip adductor torque reduces the force through the hip, thereby reducing wear and tear on the cartilage at the hip. Wear and tear of the knee joint and the hip joint are effectively reduced, thereby preventing or delaying knee and hip osteoarthritis. An additional benefit of the embodiments of the present invention is reduction of the ankle joint inversion torque which reduces the likelihood of inversion ankle sprain injury; the most common type of ankle sprain injury.

By reducing the external lower extremity joint torques in the coronal plane (knee varus, hip adductor, and ankle inversion torques) and the need for counterbalancing muscle action to maintain posture stability, the embodiments improve biomechanical muscle efficiency and performance during walking, running and other weight bearing athletic endeavors. Reduction of the need for muscle activity in the coronal plane makes more energy available for performance related activities such as propelling the body forward and/or upward.

For example, by reducing the need for counterbalancing muscle activity in the coronal plane, the invention effectively frees up energy for greater activity in the sagittal (forward) plane to propel the body forward or upwards during running or jumping. The reduction in torques leads not only to reduced need for counterbalancing muscle effort, but to reduced tendon and ligamentous strain in those structures acting in the coronal plane, such that the tendency for a number of musculoskeletal strain injuries, such as hip pointers and shin splints, is reduced.

Certain embodiments of the present invention additionally provide a spring loading effect that enhances the natural coronal foot progression during gait; (1) landing on the lateral side of the heel or forefoot, (2) medial loading at the forefoot, and (3) push off on the lateral side of the forefoot/toes. Energy is stored in the foot support during medial forefoot loading which is returned to enhance the natural foot inversion necessary for push off on the lateral side of the forefoot, thereby generally enhancing push off and propulsion upward or forward and improving the performance of walking, running, jumping and other athletic maneuvers.

A foot support along all or portions of the length of the foot is provided for supporting the medial as well as lateral side of a wearer's foot. The lateral aspect of the foot support is anchored laterally and the medial aspect of the foot support is cantilevered to transfer forces from the weight of the body to the lateral side of the shoe and foot, instead of to the medial side of the shoe and foot where they would otherwise be directed. In one embodiment, portions of the medial aspect of the foot are completely cantilevered during weight bearing such that the medial side is floating. In another embodiment, portions of the medial aspect of the foot are supported by a cantilevering upward force but are partially cantilevered, that is, not completely cantilevered, during weight bearing insofar as there may be additional support for the medial aspect of the foot from other materials within the shoe. In one embodiment of the invention, the cantilevered medial foot support is contained within the midsole and is mated to the upper and the outer sole of a shoe at various locations and by numerous mating techniques. In a still further embodiment, the shape of the foot support changes during use, as where the foot support includes an angle between the foot supporting structure and/or the medial support element and the anchoring structure that is reduced during loading and is restored at push off to provide a restoring force.

The cantilevered foot support simultaneously prevents medial foot or arch collapse, prevents foot pain and deformities, and improves ankle stability thereby reducing the likelihood of an ankle sprain injury. By reducing joint torques in the coronal plane, less counterbalancing muscle effort is required to maintain postural stability such that overall muscle efficiency is improved, which thereby improves performance. Also, by reducing the need for counterbalancing muscle effort in the coronal plane, the tendency for muscle and tendon strain (such as hip pointers and shin splints) is reduced.

In addition to the aforementioned benefits, footwear constructed according to the present invention also provides added wearer comfort.

BRIEF DESCRIPTION OF THE DRAWINGS

The invention will be more fully understood from the following detailed description taken in conjunction with the accompanying drawings, in which like reference numerals designate like parts throughout the figures, and wherein.

DETAILED DESCRIPTION OF THE INVENTION

Embodiments of the present invention relate to a shoe construction for preventing knee and hip osteoarthritis and simultaneously improving athletic performance. More particularly, the embodiments provide a footwear construction that reduces the external torque about the knee (varus) and the hip (adductor). In general, a cantilevered medial foot support is provided for supporting the medial side of a wearer's foot. The foot support is anchored laterally and cantilevered medially to transfer forces from the weight of the body that would otherwise be directed to the medial side of the shoe and foot, to the lateral side of the shoe and foot.

Figure 1:
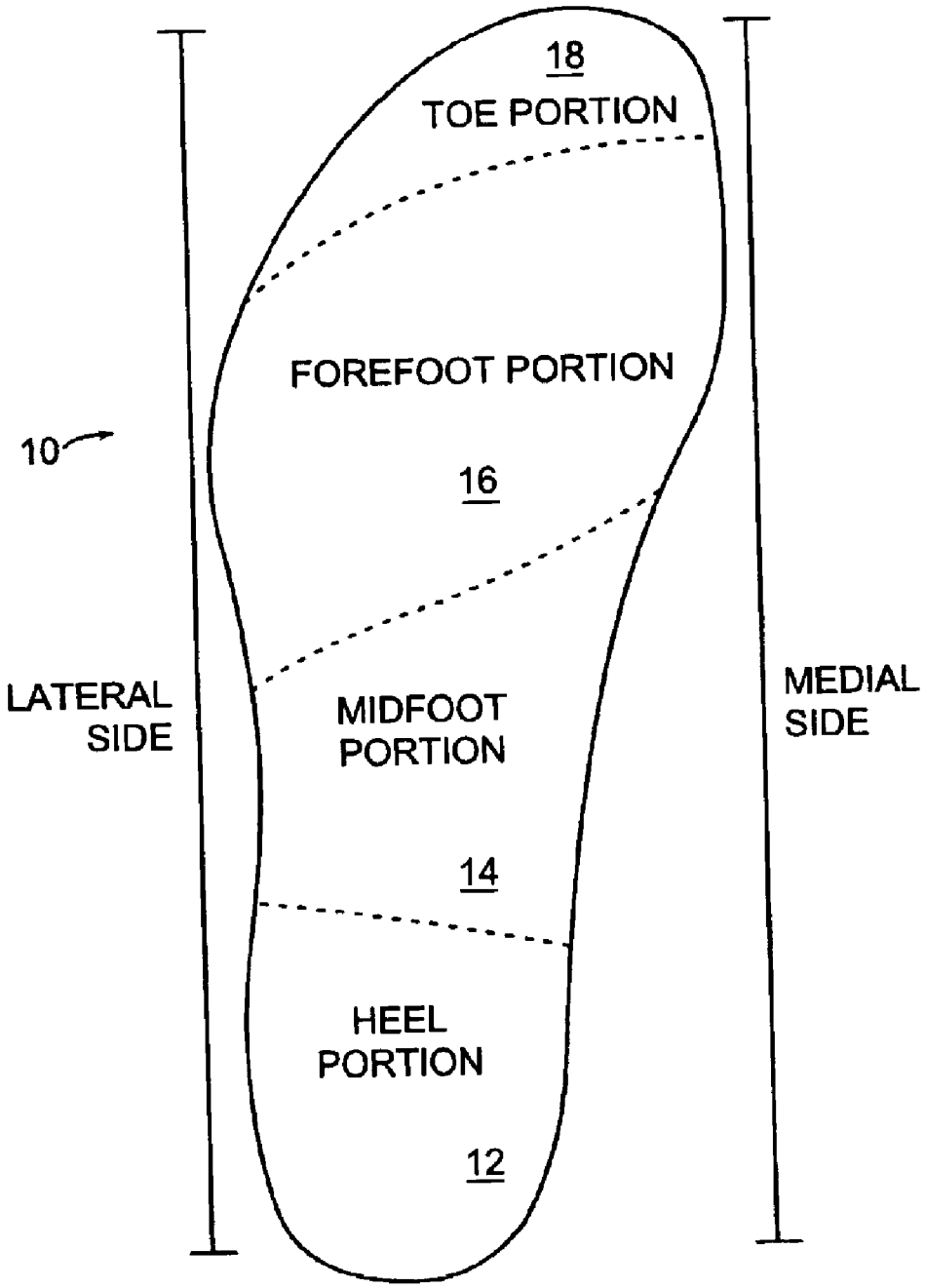
FIG. 1 PRIOR ART
FIG. 1 illustrates a top-view of the prior art portions of a foot.

FIG. 1 illustrates the various portions of a foot 10, including the heel portion 12, midfoot portion 14, forefoot portion 16, and toe portion 18.

Figure 2:
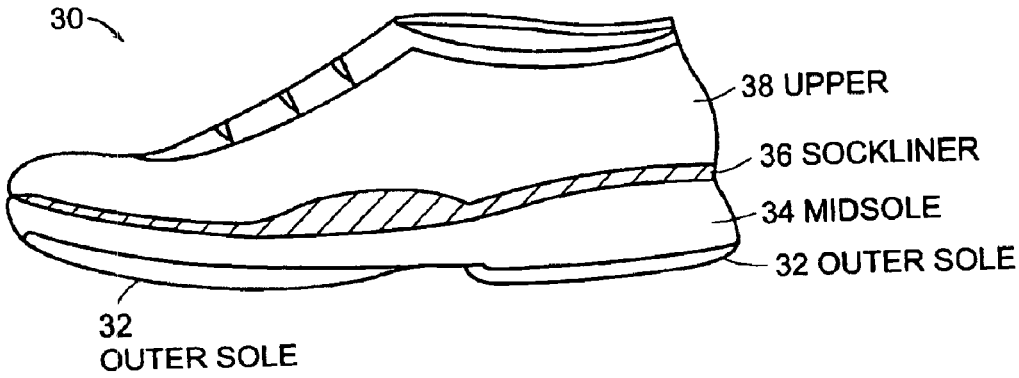
FIG. 2 illustrates a side-view of a shoe having an outer sole, midsole, sock liner, and upper according to one embodiment of the present invention.

FIG. 2 illustrates an article of footwear 30, such as an athletic shoe, sports shoe, or running shoe. Generally, the shoe 30 includes an outer sole 32 which makes direct contact with the ground surface, a midsole 34 arranged on an upper portion of the outer sole, and an upper 38 extending upwardly from the periphery of the midsole. The shoe can also include an insole insert (not shown) disposed on the midsole 34, and/or a sock liner 36 disposed on the midsole 34 or insole and surrounded by the shoe upper. The sock liner 36, or the insole insert, and the upper 38 together form a space to accommodate a human foot.

Embodiments of the present invention can be incorporated into many types of footwear, including the shoe illustrated in FIG. 2, regardless of the structure or style of the upper, midsole, or outer sole. The present invention can also be incorporated into virtually all or any part of the shoe along its length from the heel to the toe region. In one embodiment, the primary features of the invention are incorporated into the midsole 34, which can be incorporated into a desired shoe design. Alternatively, the midsole 34 can be of any conventional design, and the shoe can include an insole insert, sock liner 36, outer sole 32, or the like, incorporating the features of the present invention.

As used herein, the term "midsole" is intended to include midsoles, insole inserts, outer soles, sock liners, and the like.

Figure 3:
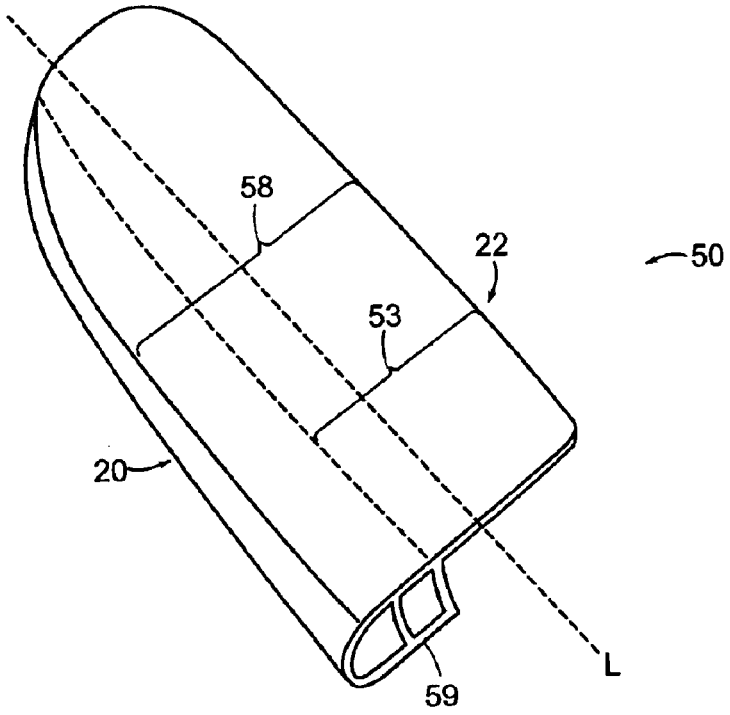
FIG. 3 illustrates a perspective view of a cantilevered foot support according to one embodiment of the present invention.

FIG. 3 illustrates a cantilevered foot support 50 according to one embodiment of the present invention. The foot support 50 includes a lateral side 20, a medial side 22, and a foot supporting structure 58. As illustrated in FIG. 3, the foot support 50 may have a size such that it extends the full width of the foot and extends continually along the longitudinal axis L from the heel 12 to the forefoot 16. Alternatively, the foot support 50 may have a size such that it extends portions of the width of the foot along portions or the entire length of the foot.

In another embodiment of the invention, the foot support 50 is discontinuous along the length of the foot, or alternatively, two or more foot supports 50 are present; for instance, a foot support 50 may span the length of the heel and another foot support 50 may span the length of the forefoot with no cantilevered support at the midfoot.

Figure 4A:
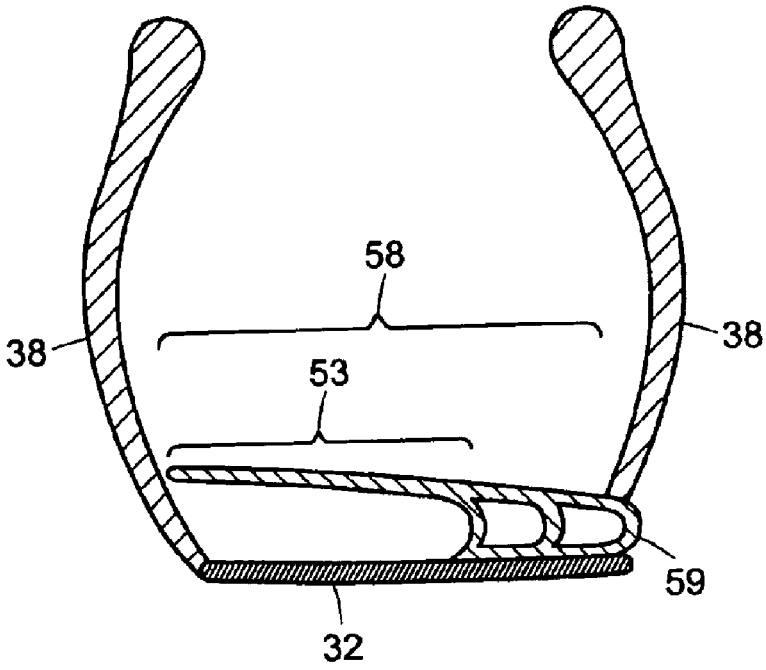
FIGS. 4A and 4B illustrate cross-sectional views at the heel and at the forefoot, respectively, of the cantilevered foot support of FIG. 3 anchored to the outer sole and to the upper of FIG. 2.

The foot supporting structure 58 of the foot support 50 includes a medial support element 53. The anchoring structure of the foot support 59 may extend medially from the lateral side 20, as illustrated in FIG. 4. In one embodiment of the present invention, the medial support element 53 is supported solely by attachment at one or more portions of the heel, midfoot, or forefoot to the anchoring structure of the foot support 59, such that medial support element 53 completely floats above the ground, as illustrated in FIG. 4A. In this embodiment, the medial support element 53 is completely cantilevered.

Figure 4B:
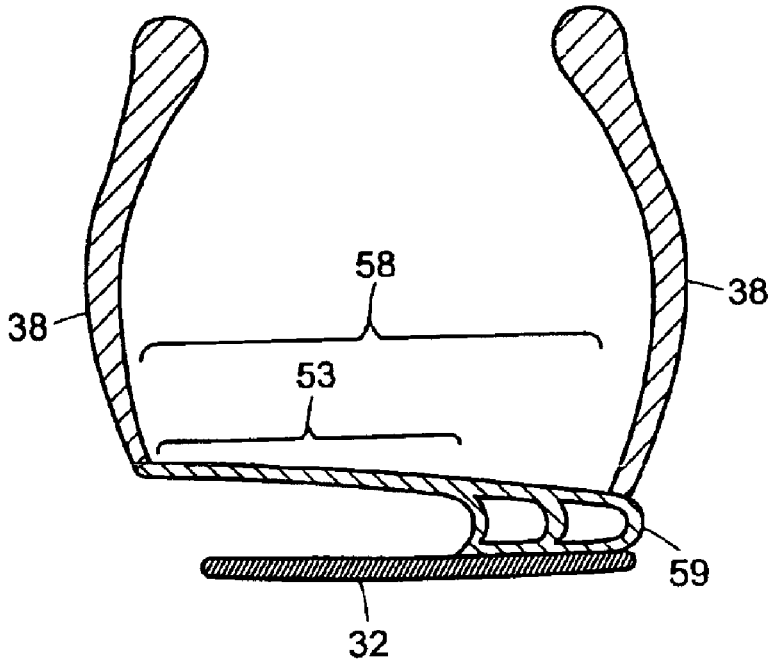

In a different embodiment, attachment of medial support element 53 to anchoring structure of the foot support 59, where medial support element 53 extends horizontally in the manner of a cantilever beyond the points of its attachment to anchoring structure of the foot support 59, provides some and preferably the major portion of the upward force to the medial support element 53, with additional upward support for the medial foot during weight bearing derived from other sources within the shoe, such as from contact of the medial support element 53 with the midsole or from attachment of the medial side of the medial support element 53 to the upper 38, as illustrated in FIG. 4B. In this embodiment, the medial support element 53 derives additional upward force to support the medial foot during weight bearing from other sources within the shoe. That is, the foot contacting component 53 is partially cantilevered. Herein, the term cantilevered refers to a design where the medial support element 53 derives substantial upward supporting force from its attachment along its lateral side to anchoring structure of foot support 59.

Figure 5:
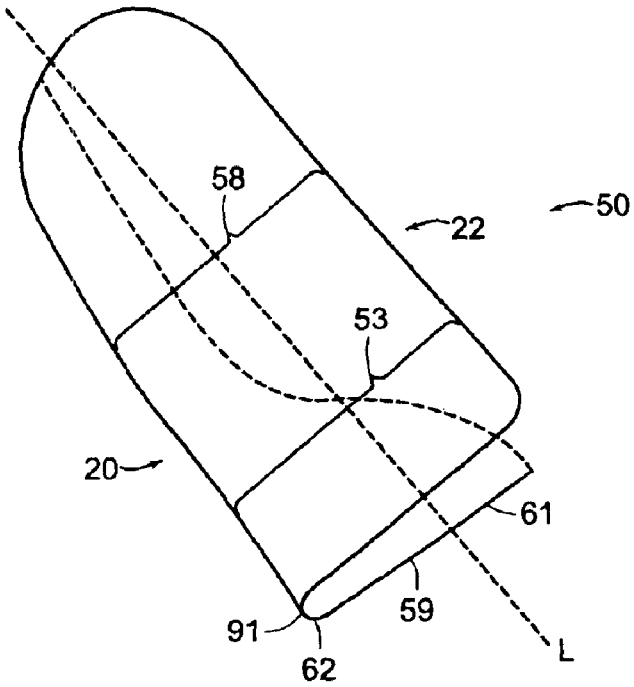
FIG. 5 illustrates a perspective view of a cantilevered foot support according to another embodiment of the present invention.
Figure 6A:
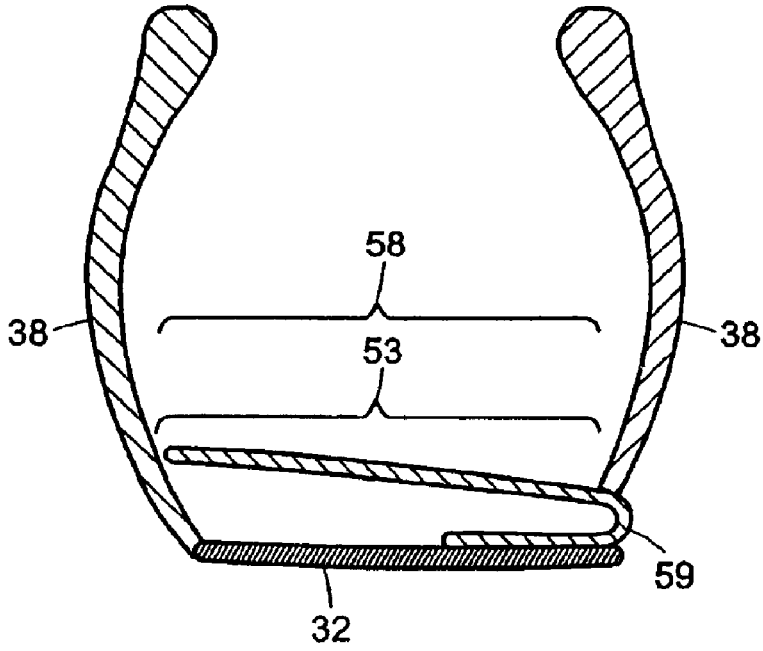
FIGS. 6A and 6B illustrate cross-sectional views at the heel and at the forefoot, respectively, of the cantilevered foot support of FIG. 5 anchored to the outer sole and to the upper of FIG. 2.
Figure 6B:
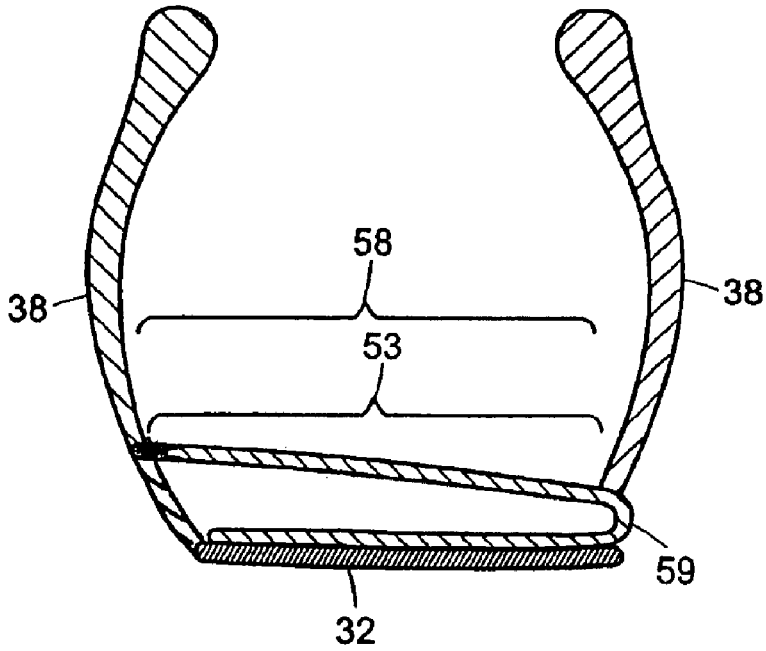

The lateral side of foot support 50 can include a bend. FIG. 5 illustrates an embodiment where foot support 50 comprises material with a U-shaped bend 91 at the lateral side of the foot support. In this case, medial support element 53 corresponds substantially to the foot supporting structure 58 and anchoring structure 59 comprises lower element 61 and rising element 62, the latter connecting with medial support element 53. In the embodiment of FIG. 5, the width of anchoring structure 59 varies, corresponding to the full width of the foot at the forefoot and to less than a full width at the heel. Cross-sectional views of these two cases are illustrated in FIGS. 6A and 6B.

Figure 7:
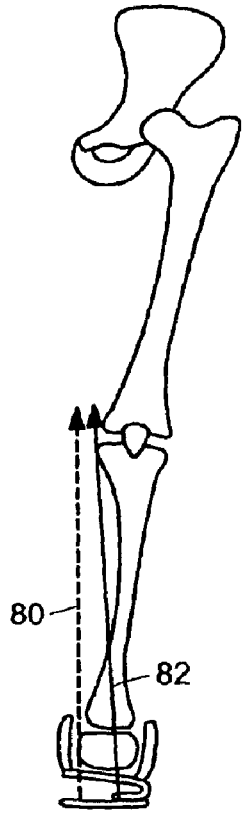
FIG. 7 illustrates the effect of the cantilevered foot supports of FIGS. 3–6 on transferring forces from the weight of the body that would otherwise be directed to the medial side of the shoe and foot, to the lateral side of the shoe and foot.

The cantilevered design of the foot support 50 is effective to transfer forces from the weight of the body that would otherwise be directed to the medial side of the shoe and foot (80), to the lateral side of the shoe and foot (82), as illustrated in FIG. 7. This lateral shift in force at the shoe and foot, illustrated in FIG. 7 effectively reduces the moment arm at the knee thereby reducing the knee varus torque. This lateral shift in force also reduces the hip adductor torque, and ankle adductor torque.

The medial support element 53 can be relatively flat or can have a variety of shapes. The size and shape of 53 can change along its length and can be discontinuous along the length of the foot. For example, 53 can be planar or convex, can be shaped at the midfoot region to accommodate the foot's natural arch, and can extend at an upward incline from the medial 22 or lateral 20 side of the foot supporting structure 58.

Figure 8A:
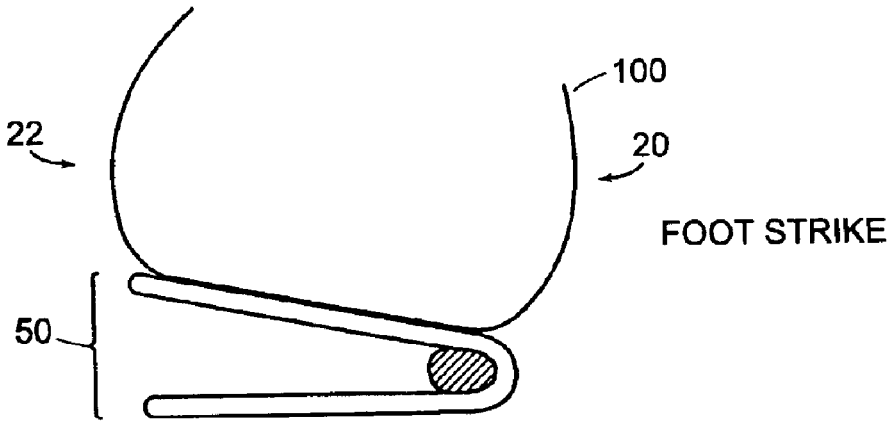
FIG. 8 illustrates the change in shape of the cantilevered foot support of FIGS. 5 and 6 during the stance period of a natural gait cycle in which the foot is inverted at foot strike, is neutral in loading and is inverted again at push-off.
Figure 8B:
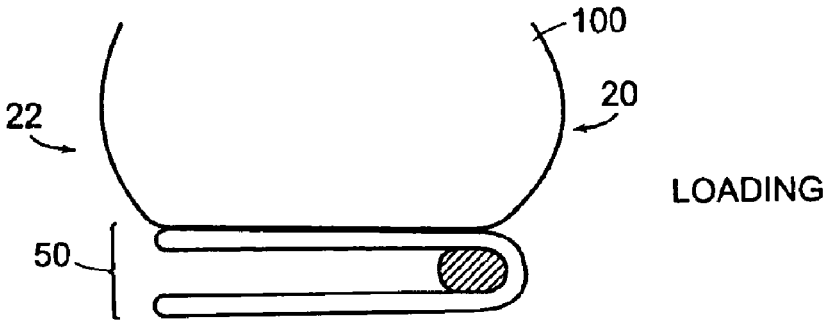
Figure 8C:
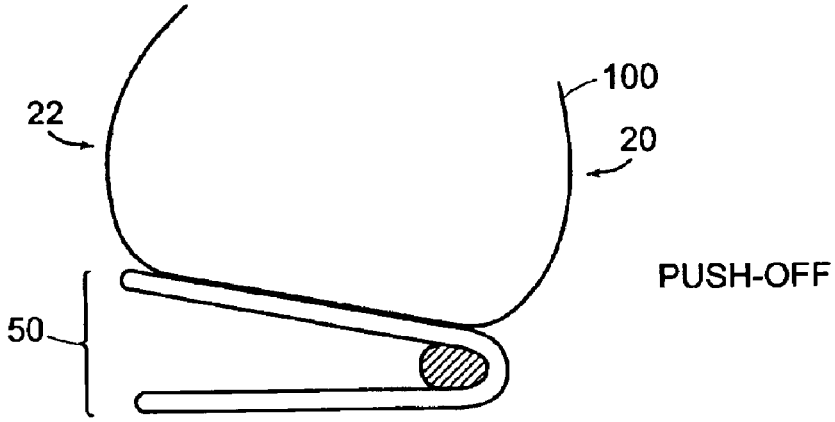

Foot support 50 can change shape during use, as illustrated in FIG. 8. For example, the medial support element 53 can have an upward incline from the lateral 20 side at foot strike when the foot 100 is naturally inverted (FIG. 8A). The medial support element 53 can bend downward with the weight of the body during the loading phase of gait (FIG. 8B) such that the foot support stores spring-like energy in this phase that is released when the medial support element 53 bends upward again at push off (FIG. 8C). This action assists with both the natural inversion and transfer of body weight force laterally.

Figure 9A:
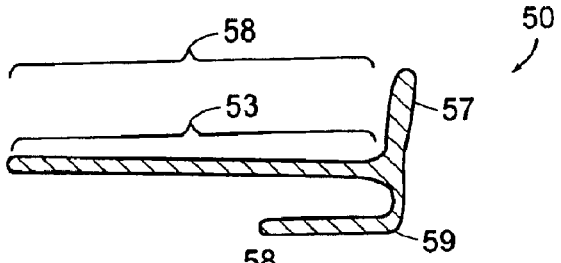
FIGS. 9A–9H illustrate cross-sectional views of possible variations in shape of the cantilevered foot support according to the present invention.
Figure 9B:
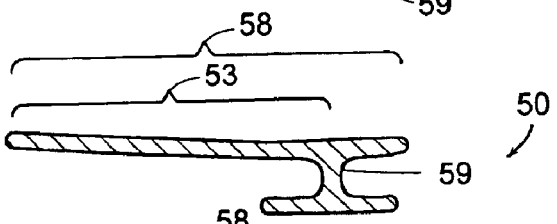
Figure 9C:
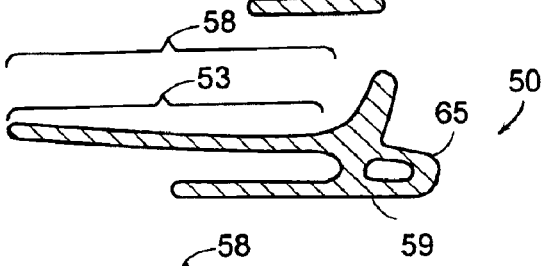
Figure 9D:
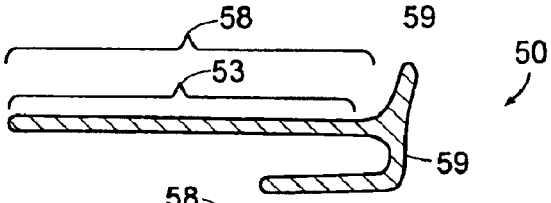
Figure 9E:
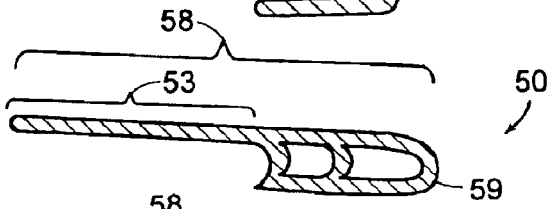
Figure 9F:
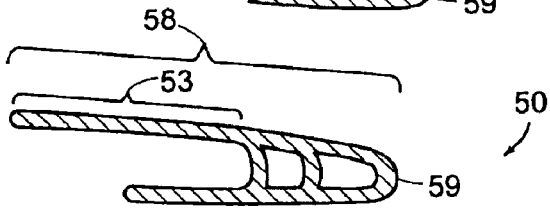
Figure 9G:
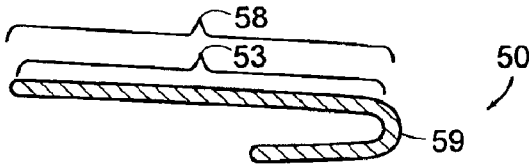
Figure 9H:
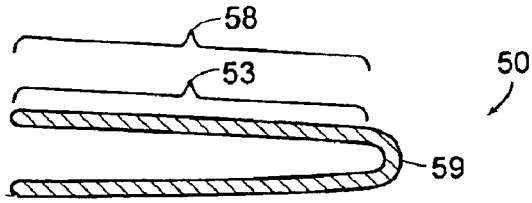
Figure 10A:
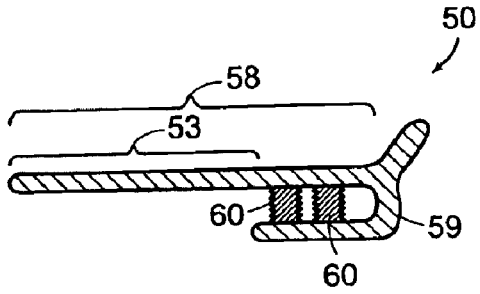
FIGS. 10A–10F illustrate cross-sectional views of the present invention in embodiments comprising different combinations of materials to form the cantilevered foot support.
Figure 10B:
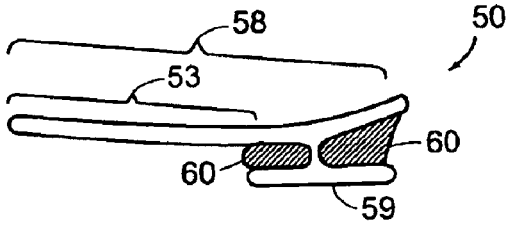
Figure 10C:
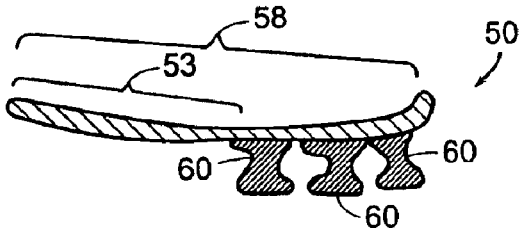
Figure 10D:
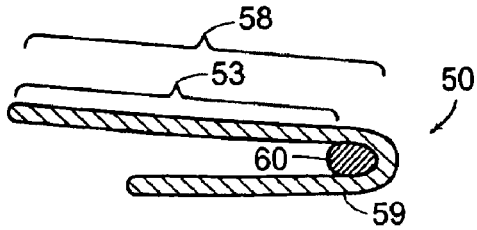
Figure 10E:
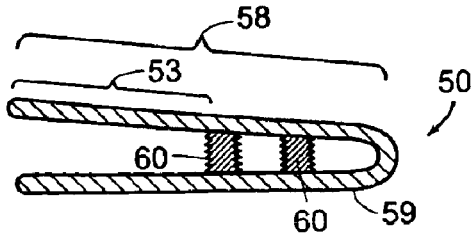
Figure 10F:
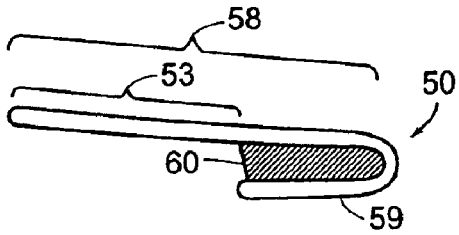

The anchoring structure of the cantilever 59 can have a variety of shapes. It can extend downwardly to contact the outer periphery of the midsole and/or outer sole of a shoe, or it can extend around the periphery of the midsole and between the outer sole and the midsole and can contain a reinforcing insert. Some examples of different shapes of the anchoring structure are illustrated in FIG. 9. For instance, if the lateral edge 20 of the foot supporting structure 58 extends laterally to the lateral edge of the foot, the cantilevered foot support may include a lateral wall 57 extending upwardly from the lateral side of the foot supporting structure 58 as shown in FIG. 9A. FIG. 9C illustrates a foot support containing a protrusion 65 of anchoring support 59 that extends laterally beyond the midsole. The size and shape of the anchoring structure 59 can change along the length of the foot and can be discontinuous, as illustrated in FIG. 5.

The foot support 50 can be made from any rigid or semi-rigid material that is effective in providing support to the medial part of the foot. The foot support 50 can also be made semi-elastic, elastic, or semi-flexible. Suitable materials from which the foot support can be made include carbon fiber material, polymers, composite materials, and naturally occurring materials such as wood, rubber and leather. The foot support can include rigid or semi-rigid reinforcing inserts that are embedded therein, such as, for example, metal, plastic, or composites, to provide added rigidity or tensile strength, and can be striated or porous to reduce weight and improve breathability.

The cantilevered foot support 50 can be made of different combinations of materials with examples illustrated in FIG. 10. For example, a different material than that used for the foot supporting structure 58 may be used for supports 60 for the foot supporting structure 58 at anchoring structure 59.

Figure 11A:
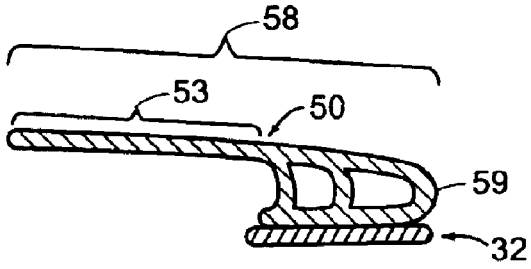
FIGS. 11A–11L illustrate cross-sectional views of the present invention in embodiments associated with different outsole and other midsole characteristics.
Figure 11B:
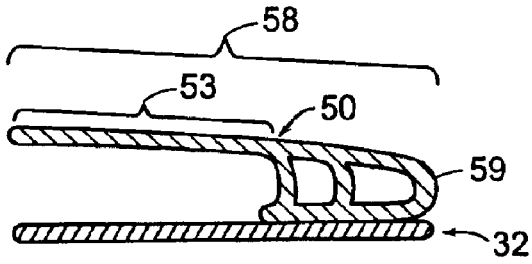
Figure 11C:
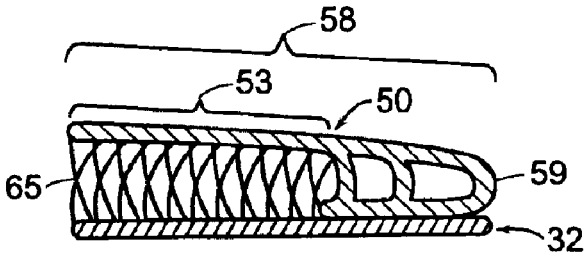
Figure 11D:
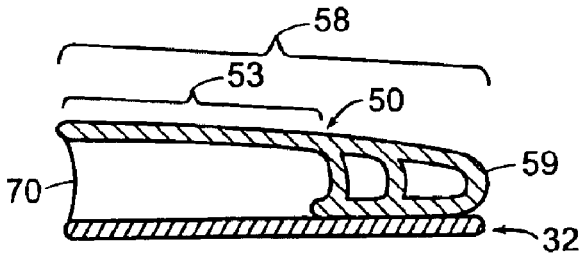
Figure 11E:
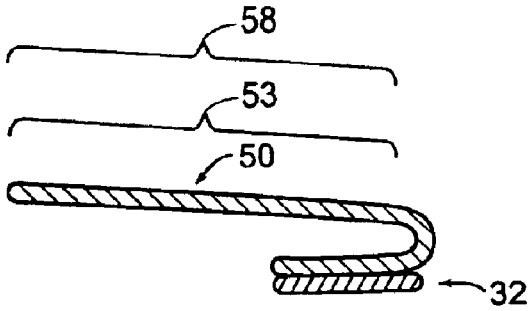
Figure 11F:
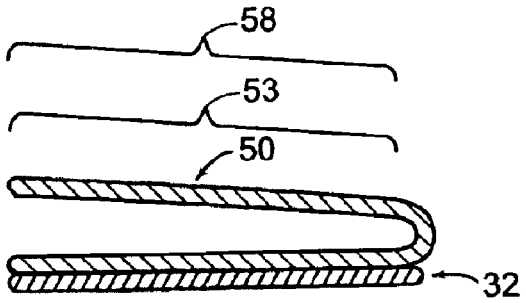
Figure 11G:
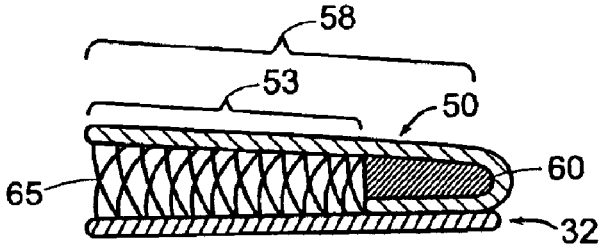
Figure 11H:
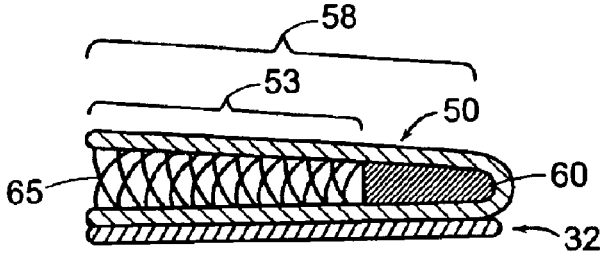
Figure 11I:
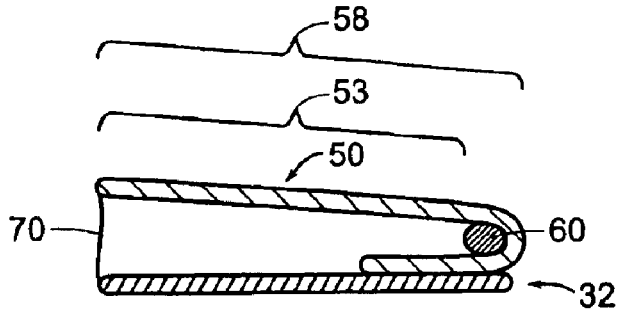
Figure 11J:
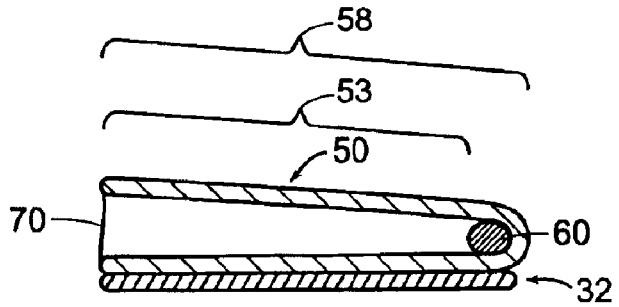
Figure 11K:
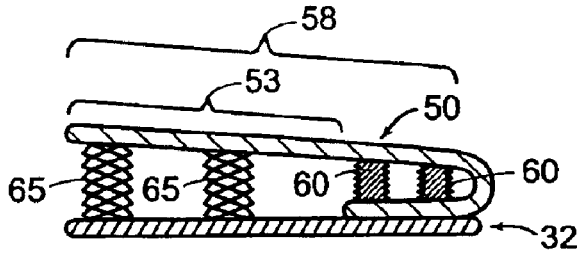
Figure 11L:
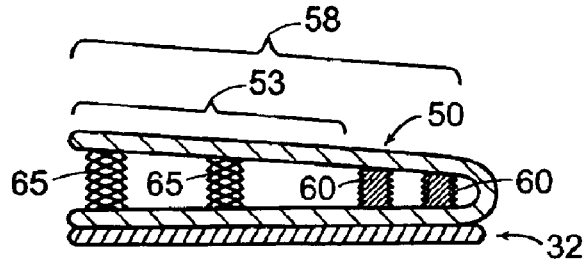

The cantilevered foot support 50 can be a component of a shoe such that the medial support element 53 is completely cantilevered at one or more portions along the heel, midfoot and forefoot. FIG. 11A illustrates a cross-sectional view of the foot support devoid of any shoe material below the medial support element 53 of the shoe. Alternatively, additional support for the medial side of the foot is derived from other structures within the shoe. For instance, the foot support 50 may be embedded in additional midsole material along one or more portions of its length such that the additional midsole material provides additional support to the medial side of the foot. Cross-sections of foot support embodiments in the context of a cantilevered foot support 50 with a U-bend are given in FIGS. 11E, 11F, 11G, 11H, 11I, 11J, 11K, and 11L. FIGS. 11C, 11G, 11H, 11K, and 11L illustrate the foot support 50 embedded in additional midsole material 65 such that the foot support 50 provides a cantilevering force to the medial support element 53 with some support for the medial foot also derived from the embedded midsole material 65. The midsole material in which the foot support may be embedded may include those well known to the foot wear industry; polymers, naturally occurring materials such as rubber and leather, gas and fluid filled bladders, and composites. Alternatively, midsole material that does not provide additional support to the medial side of the foot may be used between the outer sole and the medial support element 53 such as a flexible, non-rigid fabric like material at the medial edge of the shoe 70, illustrated in FIGS. 11D, 11I, and 11J.

The outer sole of the shoe can consist of a variety of materials and be a variety of shapes. For instance, the outer sole may extend the width of the shoe (FIG. 11B) or may be present only under the anchoring structure 59 of the cantilevered foot support (FIG. 11A).

Attachment of the cantilevered foot support 50 to the upper 38, the outer sole 32, or other midsole material can be accomplished by a variety of techniques that will be readily appreciated by one having ordinary skill in the art. For example, attachment can be effected by adhesives, ultrasonic welding, sewing, and similar techniques.

Those having ordinary skill in the art will know, or be able to ascertain, using no more than routine experimentation, many equivalents to the specific embodiments of the invention described herein. These and all other equivalents are intended to be encompassed.

All publications and references cited herein including those in the background section are expressly incorporated herein by reference in their entirety.

I claim:

1. A foot support comprising:

(a) an anchoring structure; and (b) a foot supporting structure for supporting a user foot and including a medial support element having a lateral side and a cantilevered medial side, wherein the anchoring structure extends across less than the entire width of the foot in some places, and across the entire foot width in other places and wherein the medial support element is unattached at the medial side.

2. The foot support of claim 1, wherein the foot support extends continuously along a longitudinal axis of the user foot.

3. The foot support of claim 1, wherein the foot support is discontinuous along the length of the user foot.

4. The foot support of claim 3, wherein the foot supporting structure extends across the entire width of the user foot at the heel and at the forefoot.

5. The foot support of claim 4, wherein there is no foot support at the midfoot of the user foot.

6. The foot support of claim 1, wherein the medial support element is completely cantilevered.

7. The foot support of claim 1, wherein the medial support element is partially cantilevered during weight-bearing activities.

8. The foot support of claim 7, wherein the media support element is connected to an upper of a shoe.

9. The foot support of claim 7, wherein the medial support element contacts a midsole of a shoe during weight-bearing activities.

10. The foot support of claim 1, wherein the shape of the medial support element changes along its length.

11. The foot support of claim 10, wherein the medial foot support element is shaped in the midfoot region to accommodate the natural arch of the foot.

12. The foot support of claim 10, wherein the medial foot support element extends at an upward incline from the medial side of the foot supporting structure.

13. The foot support of claim 10, wherein the medial foot support element extends at an upward incline from the lateral side of the foot supporting structure.

14. The foot support of claim 1, wherein the anchoring structure extends downward to contact an outer periphery of a shoe midsole.

15. The foot support of claim 1, wherein the anchoring structure extends downward to contact an outer periphery of a shoe outer sole.

16. The foot support of claim 1, wherein the anchoring structure extends around the periphery of a shoe midsole and between a shoe outer sole and the shoe midsole.

17. The foot support of claim 1, wherein the foot support comprises an embedded reinforcing insert.

18. The foot support of claim 17, wherein the reinforcing insert comprises a striated material.

19. The foot support of claim 17, wherein the reinforcing insert comprises a porous material.

20. The foot support of claim 1, wherein the anchoring structure comprises a first material and the foot supporting structure a second material.

21. The foot support of claim 1, wherein a shape of the foot support changes during use.

22. The foot support of claim 21, wherein the shape of the foot support is an angle between the foot supporting structure and the anchoring structure.

23. The foot support of claim 22, wherein the angle between the foot supporting structure and the anchoring structure is less during loading than at foot strike.

24. The foot support of claim 23, wherein the angle between the foot supporting structure and the anchoring structure is less during loading than at push off.

25. The foot support of claim 1, wherein there is a bend in the foot support at the lateral side of the foot support.

26. The foot support of claim 25, wherein the bend in the foot support is U-shaped.

27. A shoe comprising:

(a) an upper, a midsole, and an outer sole; and (b) a foot support including:

(1) an anchoring structure, and

(2) a foot supporting structure for supporting a user foot and including a medial support element having a lateral side and a cantilevered medial side wherein the anchoring structure extends across less than the entire width of the foot in some places, and across the entire foot width in other places and wherein the medial support element is unattached at the medial side.

28. The shoe of claim 27, wherein a plurality of portions of the medial support element are completely cantilevered.

29. The shoe of claim 27, wherein a plurality of portions of the medial support element are partially cantilevered.

30. The shoe of claim 27, wherein the foot support is embedded in the midsole at a plurality of locations along a length of the foot support.

31. The shoe of claim 30, wherein the midsole comprises a fluid-filled bladder.

32. The shoe of claim 27, wherein the outer sole extends over the width of the shoe.

33. The shoe of claim 27, wherein the outer sole extends only under the anchoring structure.

34. A shoe having a foot support according to claim 1, further comprising an upper, a midsole, and an outer sole.

* * * * *